United States Patent [19]

Vorus

[11] Patent Number: 5,046,444

[45] Date of Patent: Sep. 10, 1991

[54] BASE VENTED SUBCAVITATING HYDROFOIL SECTION

[75] Inventor: William S. Vorus, Gregory, Mich.

[73] Assignee: Michigan Wheel Corp., Grand Rapids, Mich.

[21] Appl. No.: 506,952

[22] Filed: Apr. 10, 1990

[51] Int. Cl.[5] ..... B63B 1/24

[52] U.S. Cl. ..... 114/274; 244/35 R; 416/243

[58] Field of Search ..... 114/274, 278, 126, 152, 114/140, 162; 244/35 R, 35 A; 416/223 R, 242, 243; 440/14, 15

[56] References Cited

U.S. PATENT DOCUMENTS

| | | | |
|---|---|---|---|
| 2,815,730 | 12/1957 | Horsdal | 114/140 |
| 2,936,729 | 5/1960 | Kuttner | 440/15 |
| 3,016,863 | 1/1962 | Johnson, Jr. | 114/278 |
| 3,117,545 | 1/1964 | Warner | 114/274 |
| 4,592,299 | 6/1986 | Christiansen | 114/162 |

FOREIGN PATENT DOCUMENTS

| | | | |
|---|---|---|---|
| 0191193 | 11/1982 | Japan | 114/162 |

*Primary Examiner*—Sherman Basinger

*Attorney, Agent, or Firm*—Harness, Dickey & Pierce

[57] ABSTRACT

A "fish-shaped" hydrofoil section and in particular, a hydrofoil section having a body of cross-sectional area increasing in thickness from the leading edge to a point near the midchord of the hydrofoil section. The thickness of the body then decreasing some amount to a local minimum, and thereafter increasing along concave surfaces in a "fishtail" flare to a local maximum thickness at the trailing edge. A low pressure area develops behind the trailing edge of the "fishtail" flare and is ventilated with gas at a pressure greater than that of the developed low pressure area. The cross-sectional shape of the hydrofoil section can be symmetrical or cambered.

2 Claims, 2 Drawing Sheets

FIG. 1
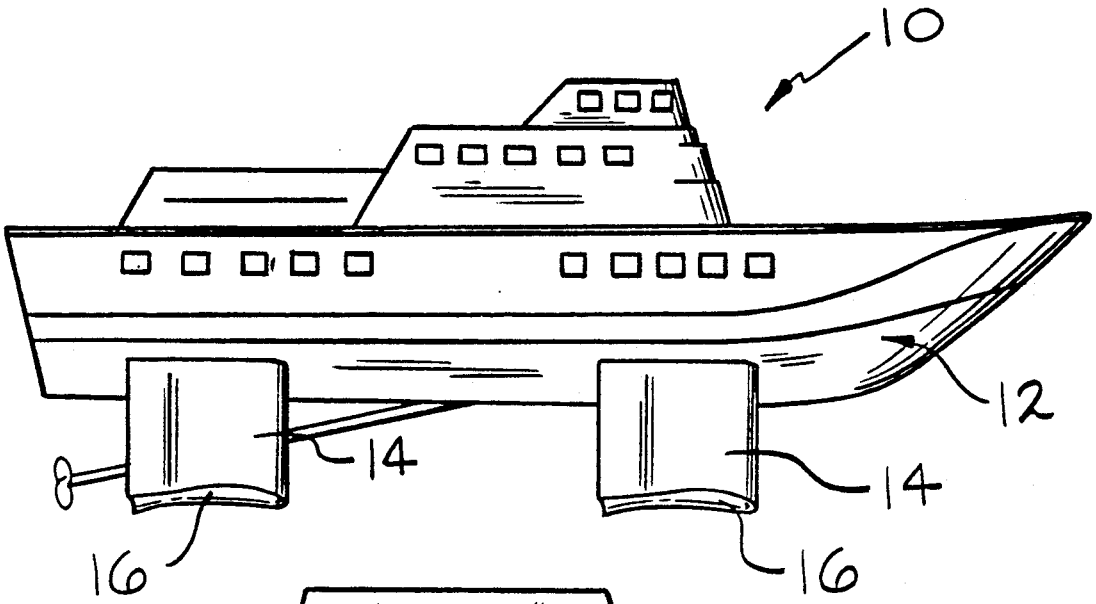
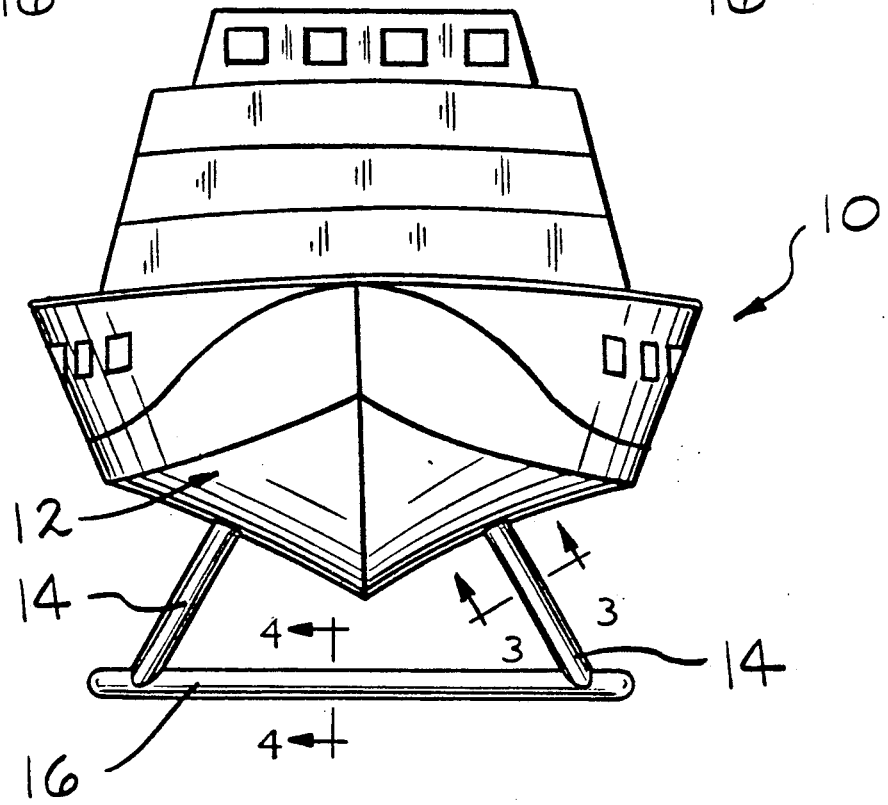
FIG. 2

BASE VENTED SUBCAVITATING HYDROFOIL SECTION

BACKGROUND OF THE INVENTION

The invention relates generally to the field of hydrofoils. In particular, the invention relates to a hydrofoil section having a "fish" shaped cross-sectional thickness and a trailing edge ventilated with a gas at or near the free stream ambient pressure.

Fundamentally, hydrofoils differ from aerofoils in that two fluid phases are possible across a hydrofoil. The two phases include a liquid phase and a gas phase. The liquid phase is water and the gas phase is water vapor or air, either separately or in combination. When the gas phase present is predominately water vapor, the hydrofoil is cavitating. When the gas phase present is predominately air, the hydrofoil is said to be ventilating. If no gas phase is present, the hydrofoil is referred to as subcavitating.

Cavitation and ventilation both appear as bubbles attached to the surface of the operating hydrofoil. This phenomenon particularly occurs over the section back (suction side) of the hydrofoil with the bubbles varying both as to size and extent. The formation of vapor bubbles will occur within a liquid in a region where the static pressure of the liquid's flow field is equal to, or less than, the saturation (vapor) pressure of the liquid. The resulting low pressure is a consequence of the local acceleration of the liquid to a relatively high velocity over the hydrofoil surface.

In order for cavitation to develop, the surface pressures on the suction side of the hydrofoil must be lower than water vapor pressure. Ventilation will develop when surface pressures exist which are lower than the ambient pressure of an externally available gas supply. The gas supplied is usually air from an atmospheric source. Although other sources may be employed.

Cavitation and ventilation are both ordinarily undesirable. While both cavitation and ventilation increase the section drag of the hydrofoil, cavitation is also barometrically unstable and can lead to problems such as vibration, excessive noise and erosion of the hydrofoil surface.

Whenever possible in the designing of hydrofoils, an attempt is made to avoid the occurrence of both cavitation and ventilation. In designing a hydrofoil for high speed applications, the development of cavitation and/or ventilation becomes increasingly difficult to avoid and if complete subcavitating conditions are insisted upon, the result is the sacrifice of low drag for adequate strength. For example, the achievement of complete subcavitating conditions in the hydrofoil sections of a planing boat propeller, having both reasonable efficiency and adequate strength, is generally impossible.

Minimum drag hydrofoil sections are often erroneously generalized as being subcavitating. In order to achieve subcavitating conditions across the hydrofoil section, measures are often taken which result in drag coefficients higher than those achieved if cavitation or ventilation was selectively designed into the hydrofoil section.

Two components of hydrofoil section drag can be identified, viscous skin friction drag and pressure drag. Viscous skin friction drag is proportional to the product of section length and section speed squared, and is generally independent of section shape. Thus, for a given speed, the viscous skin friction component of section drag is directly proportional to the length of the hydrofoil section.

Pressure drag is generally a manifestation of boundary layer separation. At low to moderate speeds, the separated boundary layer encloses a separation "cavity" of low pressure liquid. In the high speed flows of relevance to the present invention, two occurrences are possible. First, the separation cavity may vaporize to form a super cavity of vapor gas. Second, the separation cavity may be vented with some other "high" pressure gas to form a ventilation cavity. Thus, in the present invention, the pressure drag is a drag associated with the gas cavity.

For a set hydrofoil section thickness, the pressure drag varies inversely with the section length, i.e., the pressure drag becomes larger as the section becomes "blunter". If the hydrofoil section length is increased too significantly in the interest of reducing the pressure drag associated with cavitation, the surface area of the section will become so great that viscous skin friction drag will become excessive. Accordingly, in high speed applications, as section length is increased the curve of drag versus sectional length will exhibit a local minimum away from the extremes. Under these conditions, some cavitation or ventilation almost always exists for the hydrofoil section length corresponding to the minimum total section drag.

In designing for minimum drag in practical high speed applications, selectively allowing some degree of cavitation, and/or ventilation, over the hydrofoil section is required. An example is the supercavitating (or back ventilated) hydrofoil. In this case, the suction side of the hydrofoil section is entirely enveloped in gas while the pressure face of the hydrofoil is fully wetted. For optimum performance at very high speeds, a supercavitating/hydrofoil section was previously necessary.

The present invention is similar in spirit to the concept of the supercavitating hydrofoil. Namely, some amount of cavitation (in this case ventilation) is selectively allowed for by design. Ventilation gas is exploited by the present invention to achieve an improved subcavitation performance over a broader range of high speed hydrofoil applications.

A basic characteristic of the present invention is a "fish" shaped cross-sectional thickness distribution. The thickness increases from the leading edge to a point near the midchord of the hydrofoil section. Afterward, the thickness decreases some amount before again increasing in a "fishtail" flare to a local maximum at a concave trailing edge. Thus, the cross-sectional area has a "fish" configuration. The trailing edge thickness may be more or less than the midchord thickness, depending upon the requisite design demands.

Another characteristic of the present invention is that the trailing edge or base is ventilated with gas at or near free stream ambient pressure. A sufficient quantity of gas must be available to develop a full vent cavity downstream of the trailing edge. With low pressure and boundary separation developing behind the trailing edge, the relatively high pressure gas (free stream ambient pressure) will draw naturally into the vent cavity along a low pressure path originating near the gas source. As a result, both the suction side and the pressure face of the hydrofoil section will be subcavitating at the design condition.

The base vented subcavitating hydrofoil section provides many distinct advantages over conventionally designed hydrofoil sections. Relative to a subcavitating hydrofoil section of the same length and midchord thickness, the thicker "fishtail" flare and trailing edge increase the overall strength and stiffness of the base vented subcavitating hydrofoil section. Such an advantage is desirable in that most hydrofoils also serve as strength members and therefore must possess minimum cross-sectional dimensions in order to limit the effect of material stresses and deflections imposed by bending loads.

Another advantage of the present invention is that by ventilating the trailing edge, the strength increase is achieved with a very moderate increase in the overall section drag. While a relative subcavitating hydrofoil section of the same length and midchord thickness has negligible pressure drag associated with it, the base vented subcavitating hydrofoil section displays a minor pressure drag increase associated with the vent cavity. The amount of pressure drag increase will depend on the thickness gradient employed in each particular design of the "fishtail" flare. However, this pressure drag increase will be very small as compared to that which would occur if the boundary separation of the base was allowed to vapor cavitate, the natural occurrence prevented by the presence of the high pressure (atmospheric) gas supply.

The "fishtail" flare also prevents ventilation of the hydrofoil section back. The "fishtail" essentially develops high pressure fences along the trailing edge on both the section back (suction side) and section face (pressure side). Ventilation gas is thereby prevented from flooding low pressure liquid regions forwardly located on the section sides. Thus, except for the ventilation of the trailing edge, the hydrofoil section is fully wetted and subcavitating.

The "fishtail" further allows the hydrofoil section to reach higher operational speeds before vapor cavitation appears on the section back. This is accomplished because the increased thickness of the "fishtail" flare retards fluid flow velocities over the forechord of the hydrofoil section. Employing the present invention, a hydrofoil section can be designed to subcavitate at operational speeds considerably higher than a conventional aerofoil-type subcavitating section having the same length and midchord thickness. This is an important advantage of the present invention.

When incorporated into a lifting hydrofoil, the "fishtail" flare of the present invention has no effect on lift until back ventilation occurs. Upon the hydrofoil section being loaded to a level beyond its design lift, a point at which subcavitation still exists on the section face and back, the high pressure fence of the suction side trailing edge begins to breakdown and allow the suction side of the hydrofoil section to be flooded with ventilation gas. However, once back ventilation of the hydrofoil section has occurred, the designed lift development of the hydrofoil section is merely shifted from the meanline camber of the section to the camber line of the pressure face. At this load point and beyond, the face-side trailing edge of the "fishtail" operates as a trailing edge face camber, thereby "cupping" the fluid to maintain efficient lift in conjunction with low drag during back ventilated operation of the hydrofoil section.

The overall result of the present invention is a hydrofoil section which, over an increased range of operating conditions, maintains high efficiency and low drag.

Additional benefits and advantages of the present invention will become apparent to those skilled in the art to which this invention relates from the subsequent description of the preferred embodiments and appended claims, taken in conjunction with the accompanying drawings.

BRIEF DESCRIPTION OF THE DRAWINGS

FIG. 1 is a side view of a commercial craft incorporating two embodiments of the hydrofoil section of the present invention;

FIG. 2 is a front view of the craft of FIG. 1;

DETAILED DESCRIPTION OF THE DRAWINGS

Figure 3:
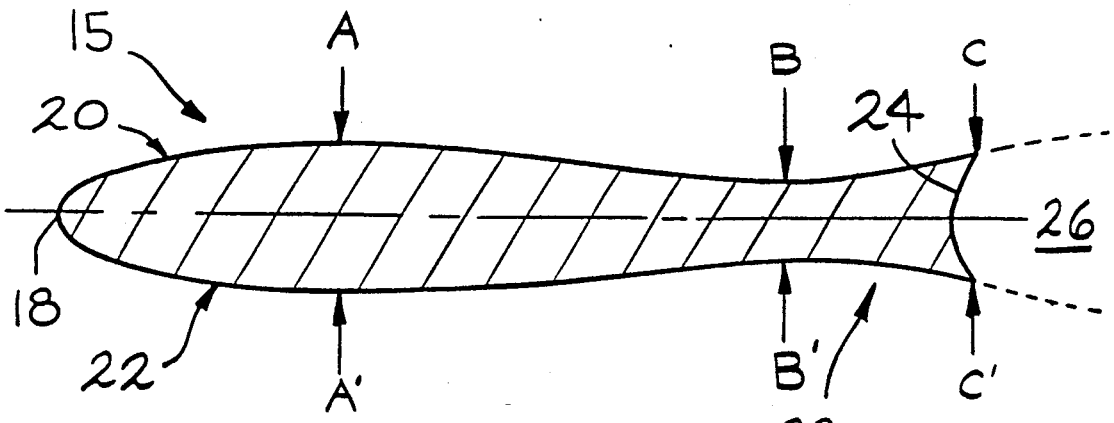
FIG. 3 is a cross-sectional view generally taken along lines 3—3 in FIG. 2 of one embodiment of the hydrofoil section of the present invention.

Now referring to the drawings, FIGS. 1 and 2 display a commercial craft 10 incorporating two embodiments of the hydrofoil section of the present invention. The mentioned drawings show a commercial craft employing a hydrofoil lifting system for illustrative purposes only. The actual invention is the hydrofoil section shape, which has a number of other possible applications. These applications include keels, diving planes, rudders, propeller blades, and the stabilization fins of marine vehicle propulsion units, in addition to hydrofoil lifting systems when applied to other types of water vehicles. The above list of possible applications is also for illustrative purposes only and is not intended to be exhaustive, as it is believed that the hydrofoil section of the present invention has possible applicability to all situations employing a hydrofoil.

Generally, there are two types of hydrofoils, lifting and non-lifting (also respectively known as cambered and symmetric). In a lifting system application of the present invention, two pairs of downwardly sloping hydrofoil struts 14 extend from the hull 12 of a boat 10. The hydrofoils struts 14 are oppositely positioned on both sides of the hull 12 and would most likely be of the non-lifting (symmetric) variety. However, a lifting (cambered) variety might also be employed. Horizontally transversing and connecting each pair of hydrofoils struts 14 is a hydrofoil 16 of the lifting variety. When the boat 10 achieves a minimum design speed, the lifting hydrofoil 16 causes the hull 12 to be raised out of contact with the surface of the water and the boat 10 glides smoothly thereacross, as neither the hull 12 nor the lifting hydrofoil 16 are significantly affected by the surface chop of the water.

Figure 4:
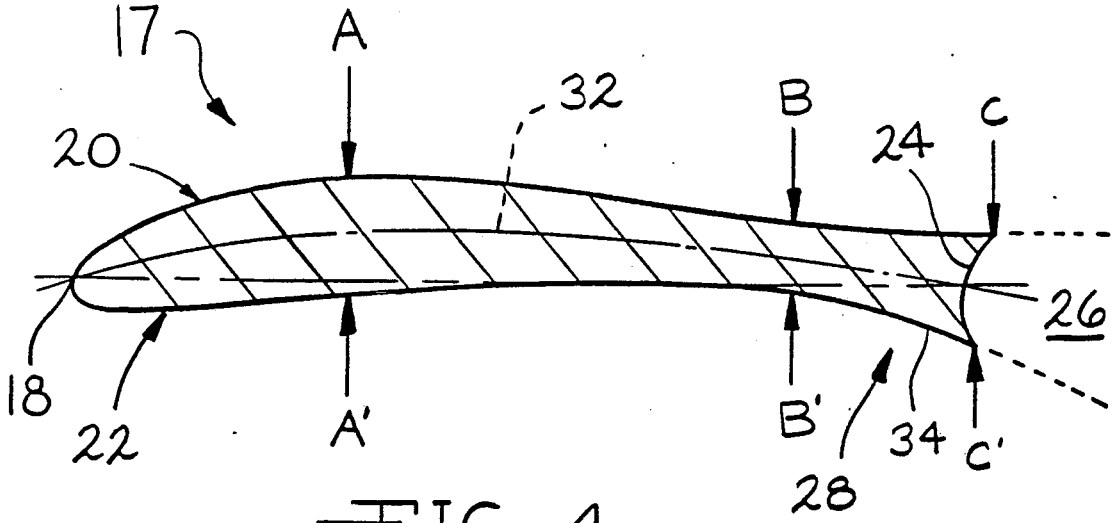
FIG. 4 is a cross-sectional view generally taken along lines 4—4 in FIG. 2 of a second embodiment of the hydrofoil section of the present invention.

The hydrofoil section of the present invention is best seen in FIGS. 3 and 4 and may be described as having a "fish" shaped cross-sectional thickness distribution. FIG. 3 shows the present invention in a non-lifting, symmetrical variety 15, while FIG. 4 displays the lifting, cambered variety 17. The following description applies equally to both hydrofoil sections 15 and 17, and where appropriate, FIGS. 3 and 4 are designated with like references.

As previously stated, a basic characteristic of the present invention is a "fish" shaped cross-sectional thickness distribution. The thickness increases along convex surfaces from a leading edge 18 to a point near the midchord of the hydrofoil section, marked A on an upper surface 20 (suction side) and A' on a lower surface 22 (pressure face). Thereafter, the upper surface 20 and lower surface 22 converge, first along convex surfaces and then along concave surfaces, decreasing the thickness of the hydrofoil section 15 until reaching a local minimum thickness, point B on the upper surface and B' on the lower surface 22. The upper surface 20 and lower surface 22 then diverge along concave surfaces in a "fishtail" flare 28, again increasing the thickness of the hydrofoil section 15, until reaching a local maximum thickness designated by C and C' at a trailing edge 24 of the hydrofoil section 15. The trailing edge 24 thickness, as marked by C and C', may be more or less than the midchord thickness, A and A', depending upon the demands of the requisite design. The trailing edge 24 is also a generally concave surface.

With the addition of the "fishtail" flare 28, the area from B to C and B' to C', and the concave trailing edge 24 of the hydrofoil section 15, a low pressure area 26 develops beyond the trailing edge 24 as the hydrofoil passes through a liquid. The concave surfaces of the "fishtail" flare 28 essentially build high pressure fence lines (not shown) along the surfaces 20 and 22 adjacent to the trailing edge 24. The function of the fence lines is further discussed below.

Operation of the hydrofoil as thus described would have two consequences. First, the appearance of vapor cavitation in the forechord of the hydrofoil section 15 would be retarded. The increased thickness of the "fishtail" flare 28 accomplishes this by decreasing the velocity of the fluid over the surfaces 20 and 22 located in the forechord of the hydrofoil section 15. With the decrease in fluid velocity, low pressure is unable to develop, vapor cavitation does not occur, and consequently, pressure drag is reduced. However, the increased thickness of the "fishtail" flare 28 and the development of the low pressure area 26 beyond the trailing edge 24 have the effect of increasing pressure drag.

In order to prevent vapor cavitation from occurring in the low pressure area 26 behind the trailing edge 24, a gas, usually air, is supplied to the low pressure area 26. This gas is at a pressure greater than the vapor pressure of the water in the low pressure area 26. The gas can be supplied to the low pressure area 26 behind the trailing edge 24 by various methods. One such method would include allowing a portion of the hydrofoil to pierce the surface of the water and extend into the atmosphere, as would occur in an application of the hydrofoil section of the present invention to the hydrofoil lifting system shown in FIGS. 1 and 2. The concave trailing edge 24 then acts as a trough and the low pressure area 26 draws the relatively high pressure atmospheric air down the length of the hydrofoil strut 14. The high pressure fence lines prevent the ventilation gas from flooding into the low pressure regions forwardly located on the upper 20 and lower 22 surfaces of the hydrofoil section 15. Thus vented with gas along the trailing edge 24, the hydrofoil section 15 of the present invention displays a minor pressure drag increase dependent only upon the thickness gradient employed in the "fishtail" flare 28.

When the hydrofoil section 15 of the present invention is used in an application where no hydrofoil will pierce the surface of the water, the gas may be vented from ports or other conventional means located in or near the trailing edge 24.

FIG. 4 shows a second embodiment of the hydrofoil section of the present invention. The lifting or cambered hydrofoil section 17, incorporates the basic structure and characteristics of the non-lifting hydrofoil section 15, shown in FIG. 3, and is designated with like references where appropriate.

When incorporated into a lifting hydrofoil section 17, the "fishtail" flare 28 of the present invention does not affect the lift induced by the meanline camber 32 of the hydrofoil section 17 until back ventilation occurs. The high pressure fence of the suction side 20 of the trailing edge 24 ultimately breaks down as the hydrofoil section 17 is loaded beyond its lift design. At this point, the suction side 20 of the lifting hydrofoil section 17 floods with ventilation gas and back ventilation occurs. Once back ventilation has fully developed, the lift of the hydrofoil section 17 is shifted from the meanline camber 32 to the camber of the pressure face 22. In this situation, the trailing edge pressure face camber 34, the camber associated with the fishtail flare of the pressure face, cups the fluid to efficiently maintain lift, along with the low drag associated with back ventilation operation.

While the above description constitutes the preferred embodiments of the present invention, it will be appreciated that the present invention is susceptible to modification, variation and change without departing from the proper scope and fair meaning of the accompanying claims.

I claim:

1. A high efficiency and low drag section of a hydrofoil for use in a liquid medium and comprising:

an elongated body having upper and lower surfaces, said body exhibiting a lateral cross-sectional shape being symmetrical about a medial axis, said cross-sectional shape having a leading edge, a midchord, a fishtail flare and a concave trailing edge forming a generally elongated depression at one end of said cross-sectional shape, said body laterally increasing in thickness from said leading edge along convex portions of said upper and lower surfaces to a point near said midchord, said body thereafter decreasing in thickness first along convex portions of said surfaces and thereafter along concave portions of said surfaces until reaching a local minimum thickness near said fishtail flare, said body thereafter increasing in thickness along concave portions of said surfaces in said fishtail flare, said increase in thickness in said fishtail flare decreasing liquid flow velocities over said body and thereby retarding vapor cavitation development along said surfaces of said body, said fishtail flare terminating in a local maximum thickness at said concave trailing edge, said concave trailing edge developing a negative pressure area adjacent thereto, said negative pressure area inducing gas flow along said trailing edge thereby fully ventilating said negative pressure area and reducing drag associated therewith.

2. A high efficiency and low drag hydrofoil for use in a liquid medium comprising:

a body being generally elongated and having upper and lower surfaces for liquid flow thereover, said body also having a meanline camber inducing a lifting force thereto, said body also including a leading edge, a midchord, a fishtail flare and a concave trailing edge, said body convexly increasing in thickness laterally along said upper and lower surfaces from said leading edge to a point near said midchord, said body thereafter decreasing in thickness first along convex portions of said surfaces and subsequently along concave portions of said surfaces until reaching a local minimum thickness at a point adjacent to said fishtail flare, said fishtail flare of said body thereafter increasing in thickness along concave portions of said surfaces until terminating in a local maximum thickness at said concave trailing edge, said concave trailing edge being generally elongated and extending along one end of said hydrofoil and developing a negative pressure area adjacent thereto for inducing gas flow along said concave trailing edge to thereby ventilate said negative pressure area and reduce drag associated with said hydrofoil.

* * * * *